US006935294B1

(12) United States Patent
Kalkstein

(10) Patent No.: US 6,935,294 B1
(45) Date of Patent: Aug. 30, 2005

(54) FLUID ACTUATED ENGINE STARTING SYSTEM AND METHOD FOR A HYBRID VEHICLE POWERTRAIN

(75) Inventor: James Kalkstein, Rochester Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 10/841,157

(22) Filed: May 7, 2004

(51) Int. Cl.[7] ..... F02N 17/00
(52) U.S. Cl. ..... 123/179.31; 123/179.16
(58) Field of Search ..... 123/179.31, 179.16, 123/179.17

(56) References Cited

U.S. PATENT DOCUMENTS 5,307,770 A * 5/1994 Davis et al. ..... 123/179.11
5,413,079 A * 5/1995 Laufer ..... 123/502
5,542,384 A * 8/1996 Rosenmann et al. ... 123/179.31

* cited by examiner

*Primary Examiner*—John T. Kwon
(74) *Attorney, Agent, or Firm*—David B. Kelley; MacMillan, Sobanski, Todd

(57) ABSTRACT

A pump-motor is used to move engine pistons to a position where the exhaust ports of a first cylinder are opened, and later to move the pistons to a position where the inlet ports and exhaust ports of the first cylinder are closed. Fuel is then injected into the first cylinder, and a starting motor is used to compress an air-fuel mixture in the first cylinder sufficiently to produce combustion of that mixture. A drive connection between a starting fluid-motor and the pistons is released. Fuel is injected into the second cylinder. The fuel-air mixture in the second cylinder is compressed sufficiently to produce combustion of that mixture.

14 Claims, 4 Drawing Sheets

FLUID ACTUATED ENGINE STARTING SYSTEM AND METHOD FOR A HYBRID VEHICLE POWERTRAIN

BACKGROUND OF THE INVENTION

The invention relates to starting an internal combustion engine. In particular, the invention pertains to a fluid motor and system for starting a compression ignition or spark ignition engine.

Use of internal hydraulically or pneumatically actuated pistons as a device to start an engine requires a fast acting servo-hydraulic valve having a high fluid flow rate. Such valves are expensive and have limited long-term prospects for cost reduction.

The engine produces pressurized hydraulic or pneumatic fluid output. Because the pressure of hydraulic output is high, the ratio of combustion-piston area to the hydraulic-piston area must be large. Due to this requirement, the cross sectional area of the fluid motor pistons is relatively small. Therefore, a very high pressure in the actuating fluid motor cylinders is required to generate a sufficiently large force in order to move the pistons fast enough and produce sufficient engine cylinder pressure to start the engine. Due to the limited fluid motor piston area, the hydraulic system may not be able to provide enough force to move the engine pistons together sufficiently to produce sufficient temperature for combustion, especially when the intake air temperature is very cold.

It is necessary to use nearly the highest hydraulic pressure possible to start the engine, approximately 6000 psi. Because the pressure against which the engine output is applied is so high, upon starting, the engine must immediately fire at the highest power level and go to the equivalent of wide open throttle from a cold start. Coolant and lubricant preheating may be required to make engine starting possible under these conditions. But such preheating is impractical in a vehicle application, except in a test cell environment.

Furthermore, a relatively large, separate accumulator must be carried on the vehicle to start the engine at anytime with such fluid actuation under these starting conditions. These requirements represent important difficulties toward integrating a hydraulic drive system in a vehicle. An alternate engine starting technique is required.

SUMMARY OF THE INVENTION

An engine to which this invention can be applied includes first and second pairs of mutually connected pistons, a first piston of each pair moving in a first cylinder, and a second piston of each pair moving in a second cylinder. Each cylinder has inlet ports and exhaust ports through which fresh air and exhaust gas enter and leave the cylinders, respectively.

The starting system includes a source of pressurized fluid, either hydraulic or pneumatic fluid, which provides power source for operating a motor- pump, driveably connected to the pistons. A starting fluid-motor is releasably connected to the pistons. The system for controlling the starting procedure includes cartridge valves, which alternately to open and close fluid communication between the fluid source, the fluid motor-pumps, and a starting fluid-motor that automatically releases or disengages the pistons after the engine starts.

The method includes using the pump-motor to move the pistons to a position where the exhaust ports of the first cylinder are opened, and using the pump-motor to move the pistons to a position where the inlet ports and exhaust ports of the first cylinder are closed. Fuel is then injected into the first cylinder, and a starter motor is used to compress an air-fuel mixture in the first cylinder sufficiently to produce combustion of the mixture. Next, a drive connection between starter motor and the pistons is released, and fuel is injected into the second cylinder. The fuel-air mixture in the second cylinder is compressed sufficiently to produce combustion of that mixture.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
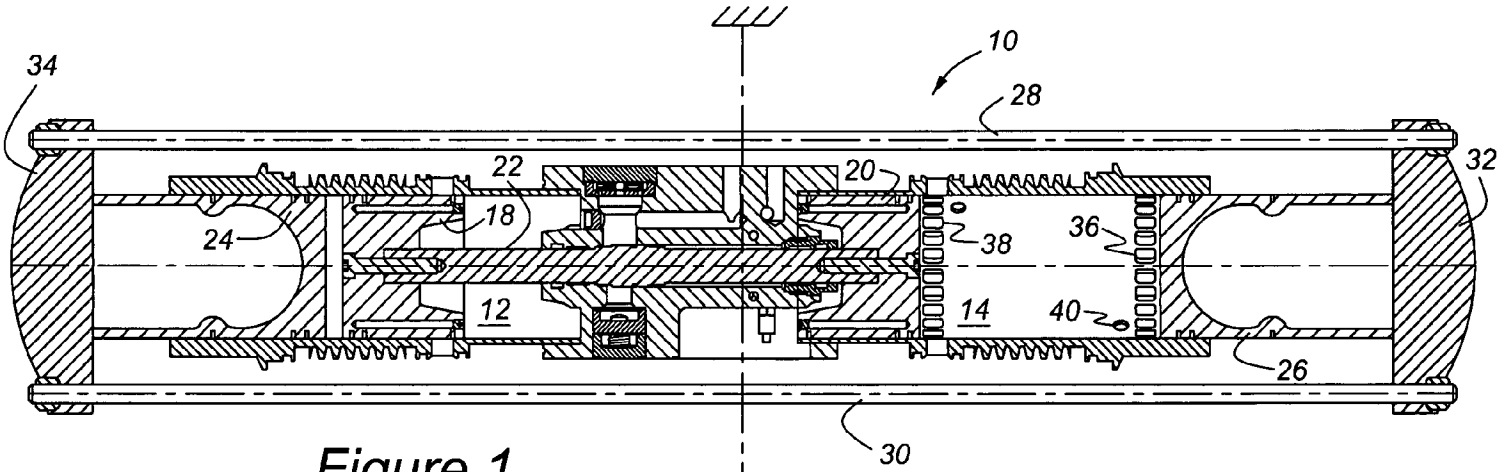
FIGS. 1 and 2 are cross sectional views taken at a longitudinal plane through a free piston engine showing schematically the arrangement of pistons and cylinders.
Figure 2:
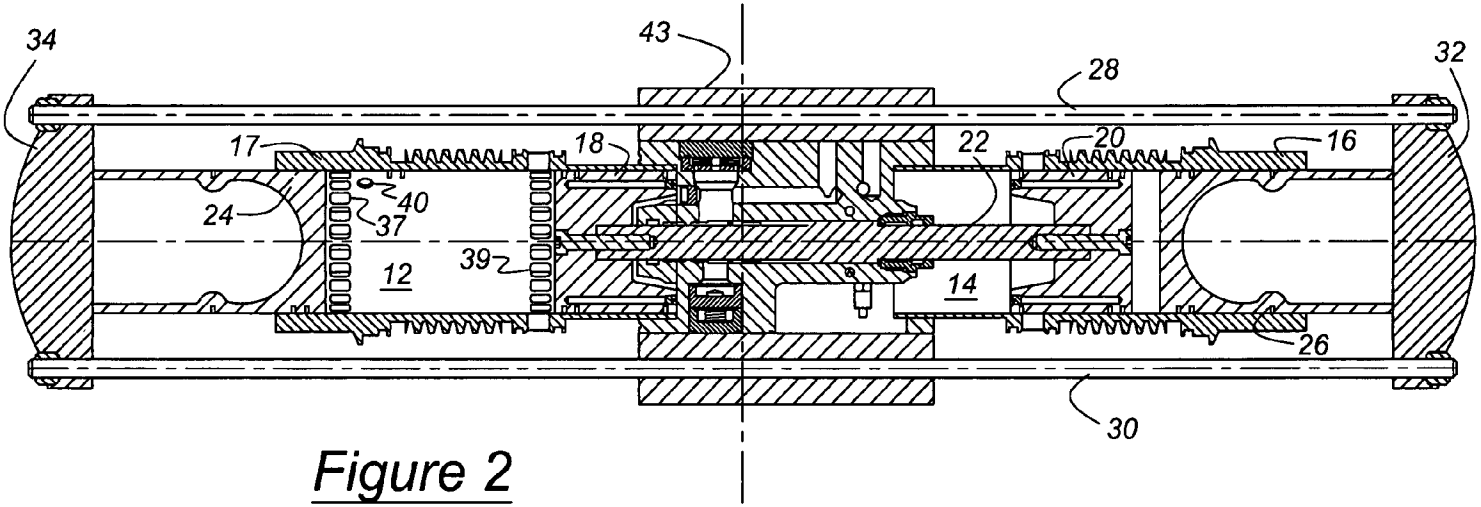

Referring first to FIGS. 1 and 2, a free piston engine 10 includes a first cylinder 12 and a second cylinder 14, axially aligned with the first cylinder, the cylinders being located in cylinder liners or engine blocks 16, 17. A first pair of pistons, inner pistons 18, 20, are mutually connected by a push rod 22. A first piston 18 of the first piston pair reciprocates within the first cylinder 12, and the second piston 20 of the first piston pair reciprocates within the second cylinder 14. A second pair of pistons, outer piston 22, 24, are connected mutually by pull rods 28, 30, secured mutually at the axial ends of pistons 24, 26 by bridges 32, 34. A first piston of the second or outer piston pair reciprocates within the first cylinder 12, and a second piston 26 of the outer piston pair reciprocates within the first cylinder 14. Each cylinder 12, 14 is formed with air inlet ports 36, 37 and exhaust ports 38, 39. In FIG. 1, the ports 37, 39 of cylinder 12 are closed by pistons 18, 24, which are located near their top dead center (TDC) position, and the ports 36, 38 of cylinder 14 are opened by pistons 18, 24, which are located near their bottom center (BDC) position. In FIG. 2, ports 36, 38 of cylinder 14 are closed by pistons 20, 26, which are located near their TDC position, and the ports 37, 39 of cylinder 12 are opened by pistons 18, 24, which are located near their BDC position. When the pistons of either cylinder are at the TDC position, the pistons of the other cylinder are at or near their BDC position. Each cylinder is formed with a fuel port 40, through which fuel is admitted, preferably by injection, into the cylinder during the compression stroke.

Displacement of the piston pairs between their respective TDC and BDC positions, the extremities of travel shown in FIGS. 1 and 2, is coordinated such that a fuel-air mixture located in the space between pistons 18, 24 in cylinder 12 and between pistons 20, 26 in cylinder 14 is compressed so that combustion of those mixtures occurs within the cylinders when the pistons have moved slightly past the TDC position toward the BDC positon. This synchronized reciprocation of the piston pairs is referred to as "opposed piston-opposed cylinder" (OPOC) reciprocation.

Figure 3:
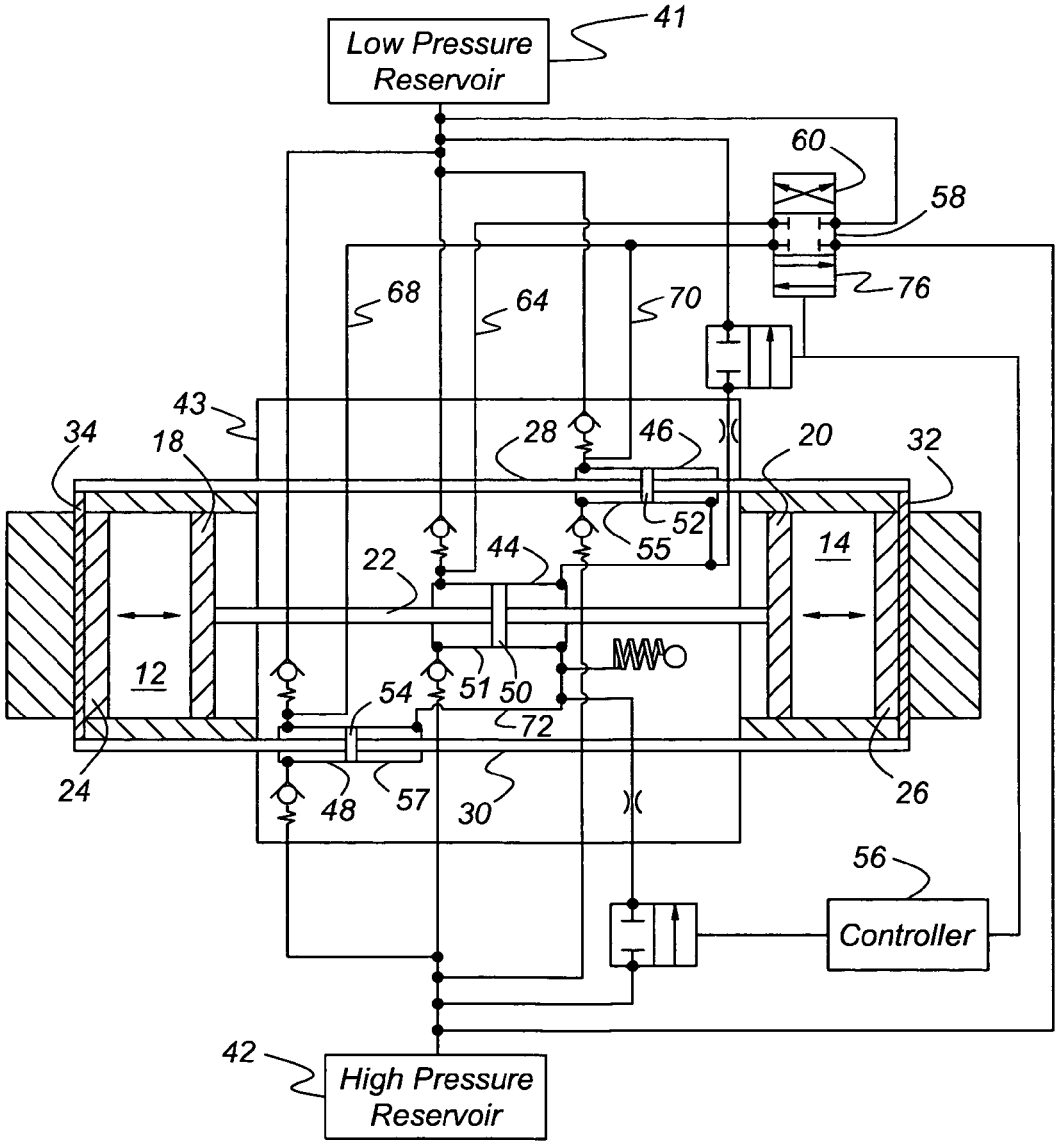
FIG. 3 is a schematic diagram of a fluid control system having a controller for operating fluid pump-motors connected to the engine piston pairs.

The synchronized, coordinated movement of the pistons is controlled through a hydraulic circuit, that includes fluid motor-pumps check valves and lines contained in a hydraulic or pneumatic block 43, located axially between the cylinder sleeves 16, 17. Referring next to FIG. 3, the control circuit includes a low pressure accumulator 41, a high pressure accumulator 42, a motor pump 44 driveably connected to push rod 22, a motor pump 46 driveably connected to pull rod 28, and a motor pump 48 driveably connected to pull rod 30. Push rod 22 is formed with a piston 50 located in a cylinder 51 formed in block 43. Reciprocation of engine pistons 18, 20 causes piston 50 of motor pump 44 to reciprocate. Pull rods 28, 30 are each formed with pistons 52, 54, located in cylinders 55, 57, respectively, formed in block 43. Reciprocation of engine pistons 24, 26 causes pistons 52, 54 of motor pumps 46, 48 to reciprocate.

When the engine 10 is running, the coordinated reciprocating movement of the engine pistons draws fluid from the low pressure accumulator 41 to the pump motors 44, 46, 48, which produce hydraulic or pneumatic output fluid flow, supplied to the high pressure accumulator 42. The motor-pumps 44, 46, 48 operate as motors driven by pressurized fluid in order to start the engine, and operate as pumps to supply fluid to the high pressure accumulator for temporary storage there or to supply fluid directly to fluid motors located at the vehicle wheels, which drive the wheels in rotation against a road load.

An electronic controller 56 produces an actuating signal transmitted to a solenoid or a relay, which, in response to the actuating signal, changes the state of a control valve 58. For example, when the hydraulic system is operating as a motor to move the engine pistons preparatory to starting the engine or while the engine is being started, controller 56 switches valve 58 between a first state 60, at which accumulator 42 is connected through valve 58 to the left-hand side of the cylinder 51 of pump-motor 44 through line 64. With valve 58 in the state 60, the left-hand sides of the cylinders 55, 57 of motor-pumps 46, 48, are connected through lines 68, 70 and valve 58 to the low pressure accumulator 41. These actions cause piston 50 to move rightward forcing fluid from pump-motor 44 through line 72 to the right-hand side of the cylinder 57, and through line 74 to the right-hand side of cylinder 55. In this way, the first state of valve 58 causes the fluid control system to move engine pistons 18, 20 rightward and engine pistons 24, 26 to move leftward from the position shown in FIG. 3.

When controller 56 switches valve 58 to the second state 76, high pressure accumulator 42 is connected through line 68 to the left-hand side of piston 57 of motor-pump 48, and through line 70 to the left-hand side of piston 55 of motor-pump 46. This forces engine pistons 24, 26 rightward. When valve 58 is in the second state 76, the low pressure accumulator 41 is connected through valve 58 and line 64 to the left-hand side of cylinder 51 of motor-pump 44. As pistons 52, 54 move rightward, fluid is pumped from cylinders 55, 57 through lines 74, 72, respectively, to the right-hand side of cylinder 51. This causes piston 50, push rod 22 and engine pistons 18, 20 to move leftward.

Figure 4:
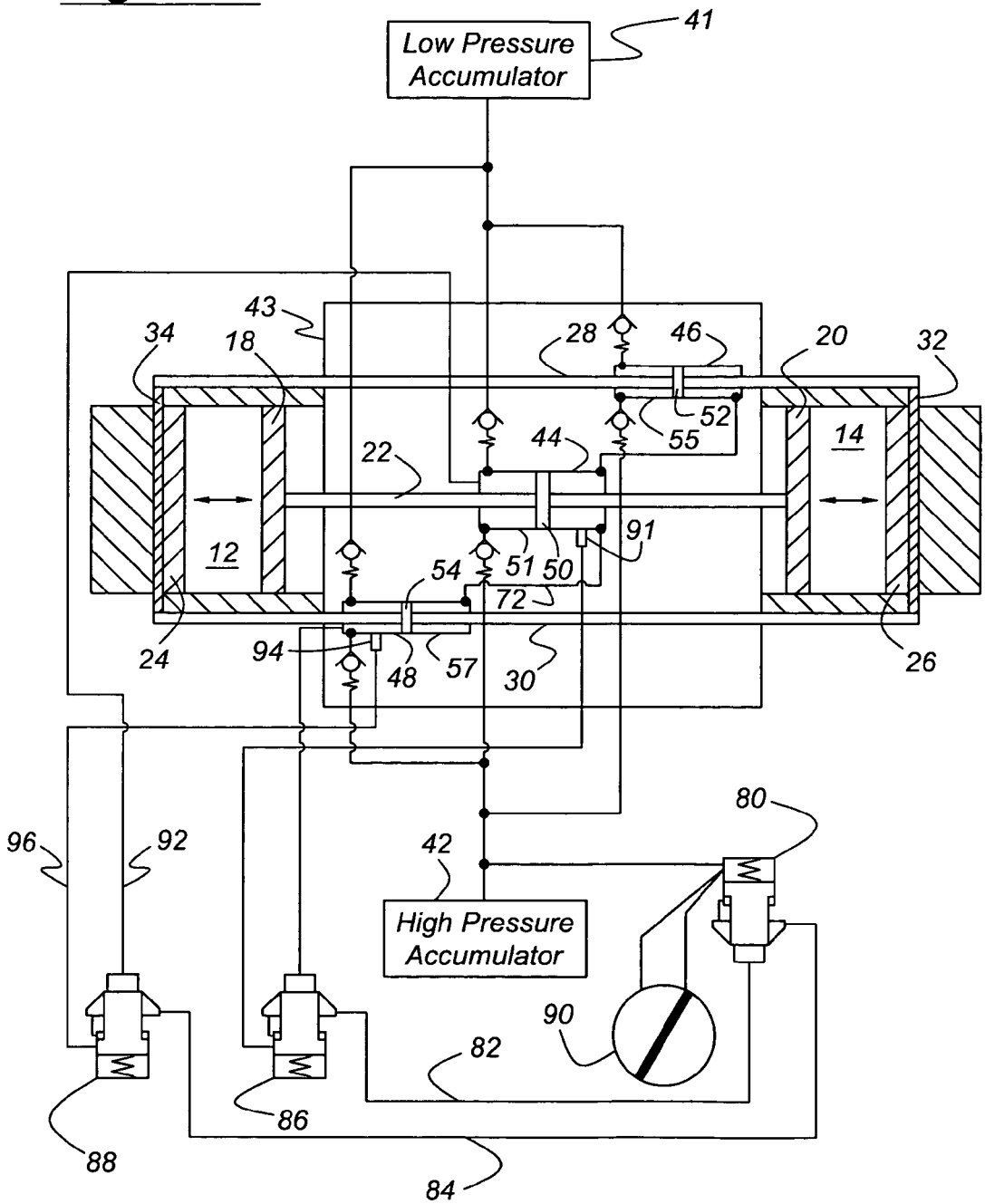
FIG. 4 is a schematic diagram of an alternate fluid control system having cartridge valves for operating fluid pump-motors connected to the engine piston pairs.

Referring now to the control system of FIG. 4, cartridge valve 80 and lines 82, 84 connect high pressure accumulator 42 to cartridges valves 86, 88. Valve 80 opens a connection between the accumulator 42 to valves 86, 88 when an engine ignition switch 90 having three positions (ON/OFF/ACCESSORY) is turned by the vehicle operator to the ON position. Valve 80 closes that connection when switch is in any position other than the ON position. A position sensor 91 produces an electrical signal when piston 50 moves to the right-hand end of cylinder 51. The signal is carried on line 92 to a solenoid or relay which, when energized, opens valve 86. Similarly, position sensor 94 produces an electrical signal when piston 54 moves to the left-hand end of cylinder 57. That signal is carried on line 96 to a solenoid or relay which, when energized, opens valve 88. Valves 86, 88 close when pistons 50, 54 are located other than at the position of the sensors 91, 94, respectively. For example, sensor 94 produces an actuating signal when the piston 54 in the outer pump-motor 48 reaches the position of sensor 94. Cartridge valves 80, 86, 88 are electromechanically actuated valves, which open when an electrical actuating signal is present at the valve winding and close when that signal is absent.

In operation, when the engine switch 90 is turned to the OFF position, the electromechanical cartridge valves move the pistons 18, 20, 24, 26 near to the TDC position in cylinder 12, the position shown in FIG. 1, at a high speed. This scavenges cylinder 14 through exhaust ports 38, and draws a fresh air charge into cylinder 14 through inlet ports 36. Immediately after that, the cartridge-valves move the engine pistons slowly to about 10 mm from the TDC position in cylinder 12, thereby closing all the inlet and exhaust ports 36–39, but leaving the fuel injector port 40 open in the combustion chamber of cylinder 14.

When switch 90 is turned to the ON position, a fuel injector injects a starting quantity of fuel into cylinder 14. This fuel quantity is preferably calibrated based on the temperature of the engine coolant. Then a fluid actuated starter motor is used to move rapidly the pistons to the TDC position shown in FIG. 2, thereby compressing the fuel-air mixture located between the pistons 20, 26 in cylinder 14 until combustion occurs there. This compression should continue until combustion occurs or the pistons 20, 26 are within a predetermined distance of touching. The distance can be varied based on engine coolant temperature. After combustion occurs, the pistons 20, 26 in cylinder 14 travel towards the TDC position in cylinder 12, the position shown in FIG. 1.

Pistons 18, 24 move rapidly in cylinder 12 due to combustion in cylinder 14. An engine controller causes a fuel injector to inject an appropriate quantity of fuel into cylinder 12 between pistons 18, 24 through fuel port 40, thereby starting the engine start. The engine continues to run under programmed control with fuel injection being actively controlled by the engine controller.

Figure 5:
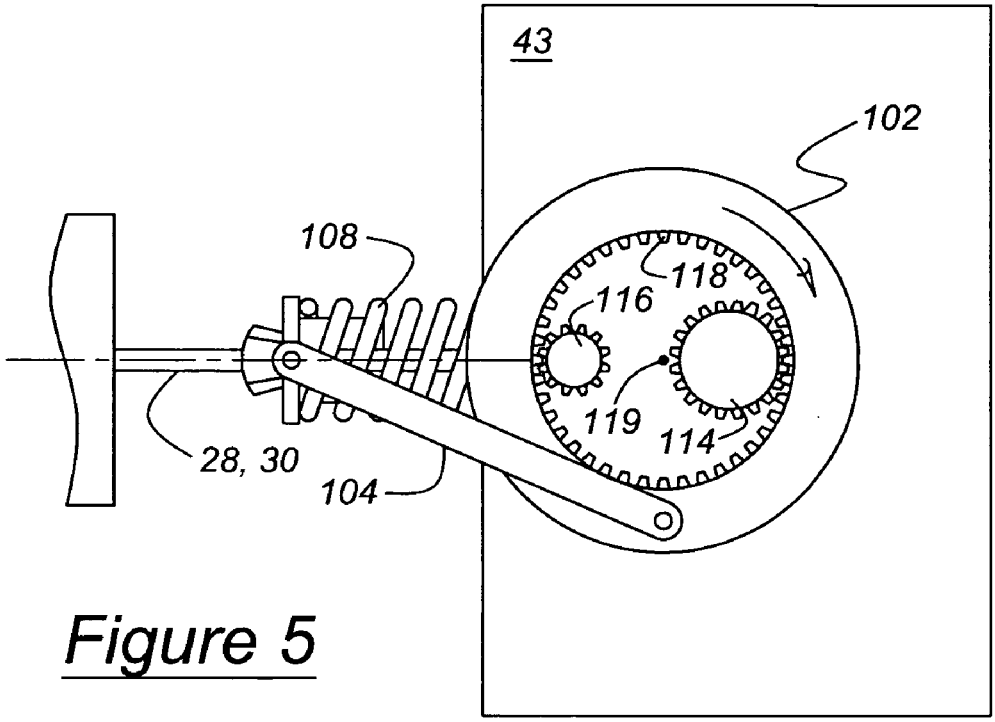
FIG. 5 is side view of a mechanism for starting the engine using a fluid-motor and a quick release device.
Figure 6:
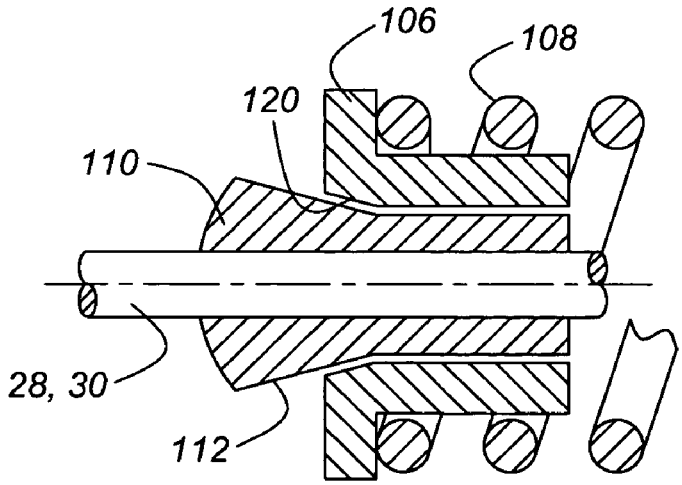
FIG. 6 is a cross section taken at a longitudinal plane through a collet, pull rod and fitting of the mechanism of FIG. 5.

Referring now to FIGS. 5 and 6, an engine starter mechanism includes a drive wheel 102, rotatably supported on fluid block 43, and a crank arm 104, secured to the wheel 102 at one end and secured to a fitting 106 at the other end. One of the pull rods 28 or 30 extends through fitting 106. A compression spring 108 continually biases fitting 106 away from block 43 and toward engagement of fitting 106 with the conical outer surface 112 on a capture collet 110, which surrounds the pull rod 28, 30. The wheel 102 is driven by a hydraulic motor 114, and an idler gear 116 engages the internal teeth 118 on the inner surface of the drive wheel 102.

A hydraulic motor 114 drives wheel 102 in rotation about its axis 119. As wheel 102 rotates clockwise when viewed as in FIG. 5, crank arm 104 forces fitting 106 leftward into engagement with the collet 110, which frictionally engages the outer surface of the pull rod. As the pull rod moves leftward with the collet and fitting, it drives the outer pistons 24, 26 leftward also because the push rod is connected to pistons 24, 26. In this way, the mechanism of FIGS. 5 and 6 operates to compress the air-fuel mixture in cylinder 14 and to force the engine pistons 20, 24 to the TDC position in cylinder 14 and pistons 18, 24 to the BDC position in cylinder 12, the positions shown in FIG. 2.

When combustion of the air-fuel mixture contained in cylinder 14 occurs in that cylinder, the push rod 28, 30 is rapidly displaced rightward in the opposite direction from the direction of its motion while using the starting motor 112 and wheel 102 to compress the air-fuel mixture in cylinder 14. The compression force of spring 108 resists leftward movement of fitting 106 and collet 110. The push rod becomes frictionally disengaged from the collet, wheel 102 and starting motor 114. Thereafter the pistons and push rod are free to reciprocate in the cylinders. After combustion in cylinder 14 occurs, fuel is injected into cylinder 12, the fuel-air mixture in cylinder 12 is compressed as the cylinders move to the position of FIG. 1, and combustion of the fuel-air mixture in cylinder 12 occurs. In this way the engine is started, the cylinders reciprocate, fuel is repeatedly injected, and combustion continues. The starting motor and starting mechanism remain idle until the engine switch is again moved to the ON position.

The fluid-actuated starting motor 114 can be replaced by an integrated alternator starter IAS, whose power source is an electric storage battery or another suitable source of electric power.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A method for starting an engine including first and second pairs of mutually connected pistons, a first piston of each pair moving in a first cylinder, a second piston of each pair moving in a second cylinder, each cylinder having inlet ports and exhaust ports, a source of pressurized fluid, a motor-pump driveably connected to the pistons, and a starting fluid motor releasably driveably connected to the pistons, the method comprising the steps of:

using the fluid source and the pump-motor to move the pistons to a position where the inlet ports and exhaust ports of the first cylinder are closed;

injecting fuel into the first cylinder;

using the fluid source and starting fluid-motor to drive the pistons in the first cylinder together and to compress an air-fuel mixture in the first cylinder sufficiently to produce combustion of the mixture in the first cylinder;

releasing the drive connection between starting motor and the pistons; and injecting fuel into the second cylinder; and compressing an air-fuel mixture in the second cylinder sufficiently to produce combustion of the mixture in the second cylinder.

2. The method of claim 1 further comprising:

before the step of using the fluid source and the pump-motor to move the pistons, using the fluid source and the pump-motor to move the pistons to a position where the exhaust ports of the first cylinder are opened.

3. The method of claim 1, wherein the step of using the pump-motor to move the pistons to a position where the exhaust ports of the first cylinder are opened further comprises the steps of:

opening a connection between the fluid source and the pump-motor; and using the fluid source as a source of power to move the pistons at a speed sufficient to scavenge exhaust gas from the first cylinder.

4. The method of claim 1, wherein the step of using the pump-motor to move the pistons to a position where the inlet ports and exhaust ports of the first cylinder are closed further comprises the steps of:

opening a connection between the fluid source and the pump-motor; and using the fluid source as a source of power to move the pistons in the second cylinder apart sufficiently to close the inlet ports and exhaust ports of the first cylinder.

5. The method of claim 1, wherein the step of injecting fuel into the first cylinder further comprises the steps of:

actuating a starter switch to start the engine;

injecting a volume of fuel into the first cylinder sufficient to produce combustion of an air fuel mixture in the first cylinder based on a temperature of an engine coolant.

6. The method of claim 1, wherein the step of using the starting fluid motor further comprises the steps of:

supplying fluid from the fluid source to the starting motor to move the pistons of the first cylinder and compress an air-fuel mixture in the first cylinder until combustion of the mixture in the first cylinder occurs.

7. The method of claim 1, wherein the step of using the starting fluid motor further comprises:

supplying fluid from the fluid source to the starting motor to move the pistons in the first cylinder a predetermined distance apart, the distance varying with a temperature of the engine coolant.

8. The method of claim 1, wherein the step of injecting fuel into second cylinder further comprises;

injecting a volume of fuel sufficient to produce combustion of the air fuel mixture in the second cylinder based on a temperature of an engine coolant.

9. The method of claim 1, further comprising the step of:

using energy released by combustion in the first cylinder to compress the air-fuel mixture in the second cylinder sufficiently to produce combustion of the mixture in the second cylinder.

10. A method for starting an engine including first and second pairs of mutually connected pistons, a first piston of each pair moving in a first cylinder, a second piston of each pair moving in a second cylinder, each cylinder having inlet ports and exhaust ports, a source of pressurized fluid, a motor-pump driveably connected to the pistons, and an integrated alternator-starter connected to the pistons, the method comprising the steps of:

using the fluid source and the pump-motor to move the pistons to a position where the inlet ports and exhaust ports of the first cylinder are closed;

injecting fuel into the first cylinder;

using the alternator-starter to drive the pistons in the first cylinder together and to compress an air-fuel mixture in the first cylinder sufficiently to produce combustion of the mixture in the first cylinder;

releasing the drive connection between starting motor and the pistons; and injecting fuel into the second cylinder; and compressing an air-fuel mixture in the second cylinder sufficiently to produce combustion the mixture in the second cylinder.

11. A system for starting an engine, comprising:

an engine including first and second axially aligned cylinders having inlet ports, exhaust ports, and a fuel delivery port, a first pair of mutually connected pistons, and a second pair of mutually connected pistons, a first piston of each pair moving in the first cylinder in mutual opposition, a second piston of each pair moving in the second cylinder in mutual opposition;

a source of pressurized fluid;

a fluid actuated motor-pump driveably connected to the pistons;

a starter motor;

a control for opening and closing a connection from the fluid source to the pump-motors; and a mechanism driveably connected to a piston pair and the starter motor, for compressing an air-fuel mixture in a cylinder, and for releasing the piston pair and starter motor upon an occurrence of combustion of the mixture in the cylinder.

12. The system of claim 10, wherein the starter motor is an integrated alternator starter.

13. The system of claim 10, wherein the starter motor is a fluid actuated motor.

14. The system of claim 10, wherein the mechanism further comprises:

a pull rod driveably connected to a piston pair;

a collet surrounding the pull rod for driveably engaging the pull rod;

a fitting surrounding the collet, driveably connected to the starting motor for forcing the collet into engagement with the pull rod as the starter motor rotates; and a biasing means opposing movement of the fitting and collet with the pull rod upon an occurrence of combustion of the mixture in the cylinder.

* * * * *